US009427675B2

(12) United States Patent
Yang

(10) Patent No.: US 9,427,675 B2
(45) Date of Patent: Aug. 30, 2016

(54) HEXAGONAL BLOCK AND ITS STAND

(71) Applicant: Mei-Tsu Lin, New Taipei (TW)

(72) Inventor: Mu-Chien Yang, New Taipei (TW)

(73) Assignee: Mei-Tru Lin (TW)

( * ) Notice: Subject to any disclaimer, the term of this patent is extended or adjusted under 35 U.S.C. 154(b) by 0 days.

(21) Appl. No.: 14/172,921

(22) Filed: Feb. 5, 2014

(65) Prior Publication Data

US 2015/0217206 A1 Aug. 6, 2015

(51) Int. Cl.
*A63H 33/04* (2006.01)

(52) U.S. Cl.
CPC ..... *A63H 33/04* (2013.01)

(58) Field of Classification Search
USPC ..... 446/85, 117, 118, 124
See application file for complete search history.

(56) References Cited

U.S. PATENT DOCUMENTS

| | | | | | |
|---|---|---|---|---|---|
| 1,725,911 | A | * | 8/1929 | Graham | 446/118 |
| 3,487,579 | A | * | 1/1970 | Brettingen | 446/128 |
| 3,877,170 | A | * | 4/1975 | Bakker | 446/124 |
| 3,945,645 | A | * | 3/1976 | Roberts | 273/157 R |
| 4,133,538 | A | * | 1/1979 | Ambrose | 273/276 |
| 4,183,167 | A | * | 1/1980 | Jatich | 446/118 |
| 4,257,609 | A | * | 3/1981 | Squibbs | 273/241 |
| 4,964,834 | A | * | 10/1990 | Myller | 446/118 |
| 4,974,849 | A | * | 12/1990 | Kasuya et al. | 273/157 R |
| 5,048,840 | A | * | 9/1991 | Johnson, Jr. | 273/241 |
| 5,057,049 | A | * | 10/1991 | Kaczperski | 446/128 |
| 5,088,951 | A | * | 2/1992 | Majurinen | 446/91 |
| 5,301,953 | A | * | 4/1994 | Levin | 273/276 |
| 5,711,524 | A | * | 1/1998 | Bauer et al. | 273/157 R |
| 5,800,239 | A | * | 9/1998 | Cohen | 446/85 |
| 5,876,262 | A | * | 3/1999 | Kelly et al. | 446/118 |
| D411,261 | S | * | 6/1999 | Movsesian | D21/484 |
| 6,220,919 | B1 | * | 4/2001 | Cheng | 446/117 |
| 6,443,796 | B1 | * | 9/2002 | Shackelford | 446/91 |
| 7,040,621 | B2 | * | 5/2006 | Cheng | 273/160 |
| 7,694,463 | B2 | * | 4/2010 | Lanahan | 52/81.1 |
| 8,002,241 | B1 | * | 8/2011 | Shaw | 254/88 |
| 8,020,867 | B2 | * | 9/2011 | Cheng | 273/157 R |
| 8,480,449 | B2 | * | 7/2013 | Cheng | 446/124 |
| 8,567,785 | B1 | * | 10/2013 | Cheng | 273/287 |
| 8,986,012 | B1 | * | 3/2015 | McGee | 434/211 |
| 2008/0274665 | A1 | * | 11/2008 | Cheng | 446/118 |

* cited by examiner

*Primary Examiner* — Melba Bumgarner
*Assistant Examiner* — Joseph B Baldori

(57) ABSTRACT

The present invention is related to a hexagonal block and its stand consistent of various three-dimensional blocks and each of the blocks including one to multiply hexagonal elements constituted by multiply layers of connection in horizontal and vertical directions. Thereby the same blocks can be stacked in either vertical direction in accordance with the corresponding stand with a recess or horizontal direction in accordance with a switched stand with a recess. The blocks are in hexagonal forms at a fixed quantity such that a stacking sequence is required to complete a three-dimensional assembly without vacancy. Therefore certain difficulty is included in order to achieve the training of logic thinking.

4 Claims, 8 Drawing Sheets

HEXAGONAL BLOCK AND ITS STAND

TECHNICAL FIELD OF THE INVENTION

The present invention is related to a hexagonal block and its stand utilizing multiply different three-dimensional blocks consistent of one or multiply hexagonal elements in accordance with the corresponding stands for accommodating each of the different hexagonal elements and stacking them at different locations in different sequence so as to constitute a variety of three-dimensional forms by various ways of stacking.

DESCRIPTION OF THE PRIOR ART

An ordinary playing block is usually in the forms of cube, plate, sphere or the like that the cube can extend into different shapes mainly from the six surfaces of a cube along the axes of X, Y, namely, such structure of blocks only assembled in either horizontal or vertical directions. Human brain can relatively easily process and identify the assembly of blocks in either horizontal or vertical directions that might be helpful to children. However, the aforesaid assembly of blocks is relatively simple and thus inadequate in the educational value of logic thinking and group concept.

Later some vendors provide new cubical blocks in different forms for disassembly-assembly in accordance with the corresponding stands so as to enhance the variety of assembly. However, the new cubical blocks and stands still utilize the horizontal and vertical directions for disassembly-assembly. Successful assembly can be achieved without much difficulty through the attempts along the edges of the stands. As compared with the aforesaid ordinary blocks, the new cubical blocks and stands have enhancement in the variety and challenge of assembly but it is still considered inadequate in training value based on the above-mentioned deficiency. Therefore there is a demand for further enhancement.

SUMMARY OF THE INVENTION

The present invention is related to a hexagonal block and its stand consistent of various three-dimensional blocks stacked on the stand. Each of the blocks including one to multiply hexagonal elements constituted by multiply layers of connection in horizontal and vertical directions so as to stack the blocks in either vertical or horizontal directions in accordance with the stand with a recess into a variety of three-dimensional block assembly by different stacking sequence.

Further the aforesaid blocks can be stacked in vertical direction on the stand into a three-dimensional shape and in horizontal direction on a different stand into a different shape. In summary, the present invention has the following advantages;

1. Each block is constituted by the hexagonal elements at a fixed quantity such that stacking the blocks on the stand can stimulate the player in thinking through the block maneuver within the three-dimensional space in order to image and attempt to achieve a correct stacking sequence so as to include certain effectiveness of training and inspiration.
2. Current commercially available blocks are stacked in vertical direction only. The stand of the present invention can be changed to allow player stack the blocks in either vertical or horizontal direction so as to further stimulate the player to think of block assembly in different directions. Hence the present invention has a style of creativeness and combination of thinking. In addition, the blocks are consistent of hexagonal elements at fixed quantity such that more attempts are required to stack a three-dimensional assembly without vacancy.

As compared to the prior art, the present invention can proceed with block stacking in either vertical or horizontal direction with the same quantity of blocks in accordance with different stands. Each of the blocks is in a hexagonal form such that a proper sequence is required to stack the blocks in accordance with the stand into a three-dimensional assembly without vacancy despite in either vertical or horizontal direction. Certain challenge and difficulty are included in order to achieve the training of logic thinking through combination of stacking blocks.

BRIEF DESCRIPTION OF THE DRAWING ELEMENTS

| | | | |
|---|---|---|---|
| 10 | element | C1~C10 | plane 1~plane 10 |
| 11~17 | block A~block G | a1~a4 | first element~fourth element |
| 18 | stand | b1~b4 | first element~fourth element |
| 181 | recess | c1~c4 | first element~fourth element |
| 182~188 | location A~location G | d1~d4 | first element~fourth element |
| 19 | stand | e1~e4 | first element~fourth element |
| 191 | recess | f1~f4 | first element~fourth element |
| 201~208 | location A'~location H' | g1~g4 | first element~fourth element |

DETAILED DESCRIPTION OF THE PREFERRED EMBODIMENTS

Please refer FIG. 1 through 9 together with the brief description of drawing elements that illustrate the preferred embodiment of the present invention. The present invention is a hexagonal block and its stand that each of the blocks A to G (11~17) is consistent of four hexagonal elements (10) in either horizontal or vertical connection in multiply layers constituting seven different three-dimensional block assemblies. The description of the embodiments of the present invention is by a basic unit of element (10) for explanation as follows:

A block A(11) is in a form of a horizontal connection of a first element (a1) and a second element (a2) with a third element (a3) and a fourth element (a4) respectively attached to both sides of the horizontal connection. A block B(12) is in a form of a horizontal connection of a first element (b1) and a second element (b2) with a third element (b3) and a fourth element (b4) attached to a bottom of the horizontal connection. A block C(13) is in a form of a vertical connection of a first element (c1), a second element (c2) and a third element (c3) with a fourth element (c4) attached to a side of the first element (c1). A block D(14) is in a form of a vertical connection of a first element (d1) and a second element (d2) with a third element (d3) and a fourth element (d4) vertically connected to each other and then attached to a side of the first element (d1). A block E(15) is in a form of a vertical connection of a first element (e1), a second element (e2) and a third element (e3) with a fourth element (e4) attached to a side of the second element (e2). A block F(16) is in a form of vertical connection of a first element (f1) and a second element (f2) with a third element (e3) attached to a side of the second element (f2) and a fourth element (f4) attached to a side of the first element (f1). A block G(17) is in a form of a connection of a second element (g2), a third element (g3) and a fourth element (g4) with a first element (g1) attached to a top side of the second element (g2).

Figure 1:
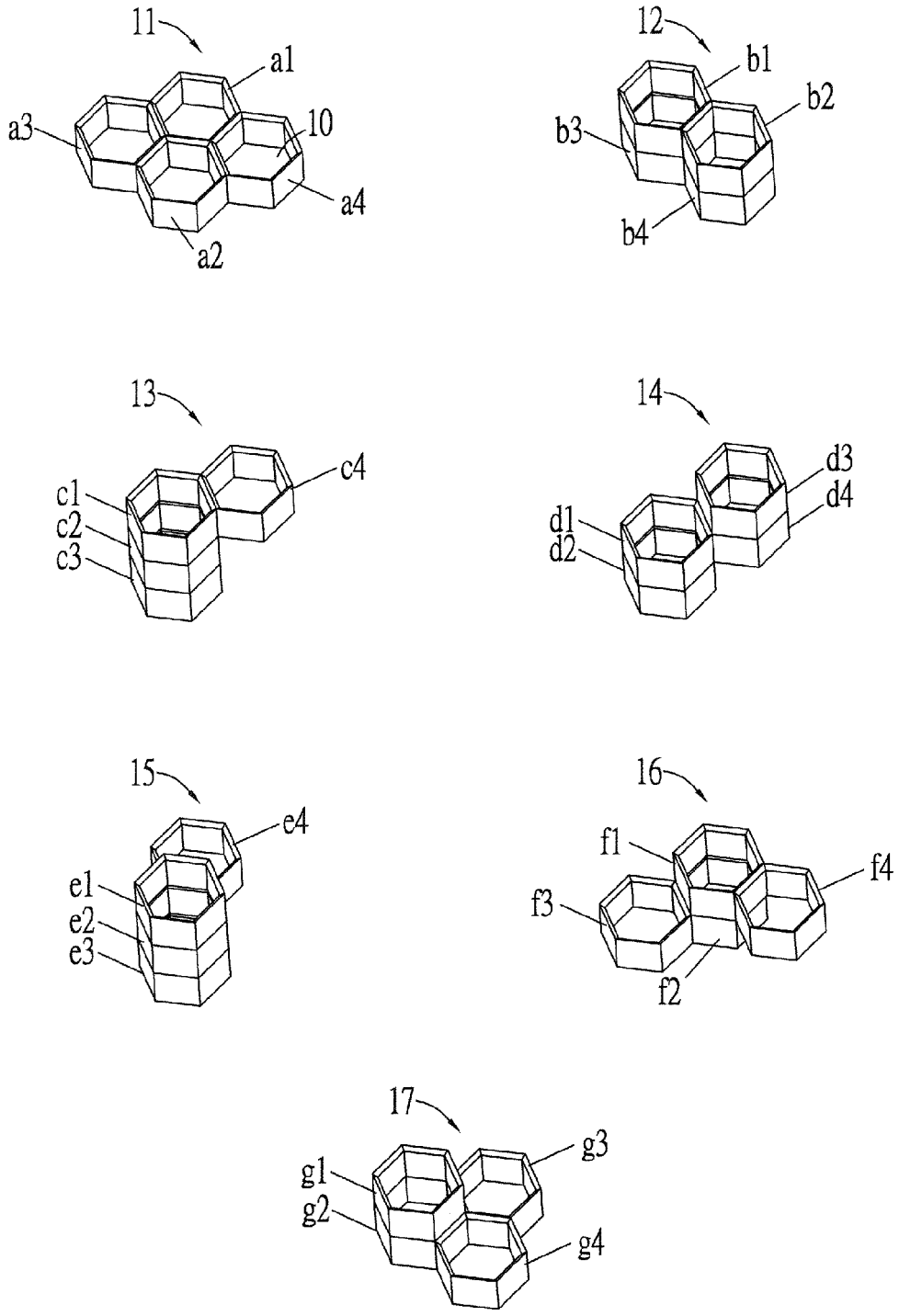
FIG. 1 is a perspective view of each element of each component the present invention.
Figure 2:
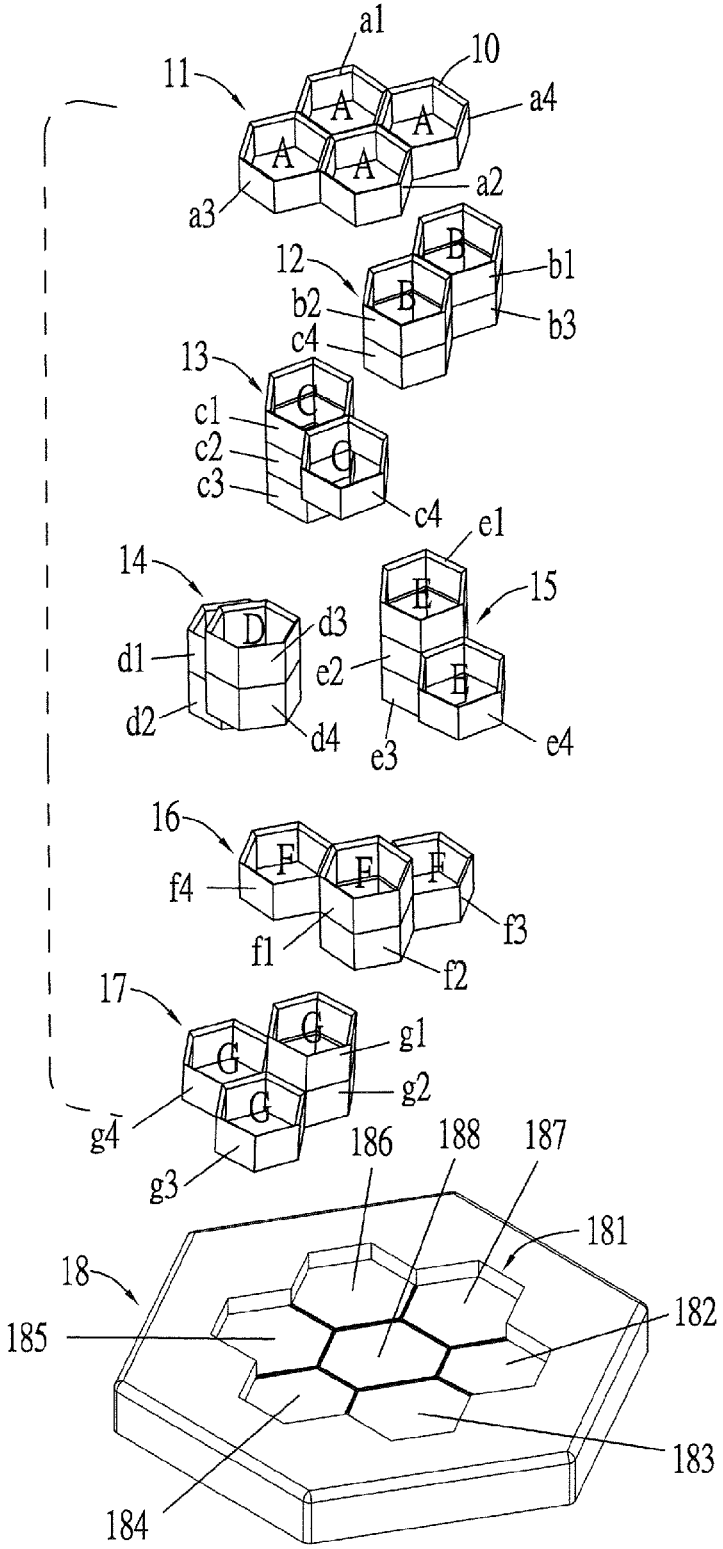
FIG. 2 is perspective view of an assembly of the present invention.
Figure 3:
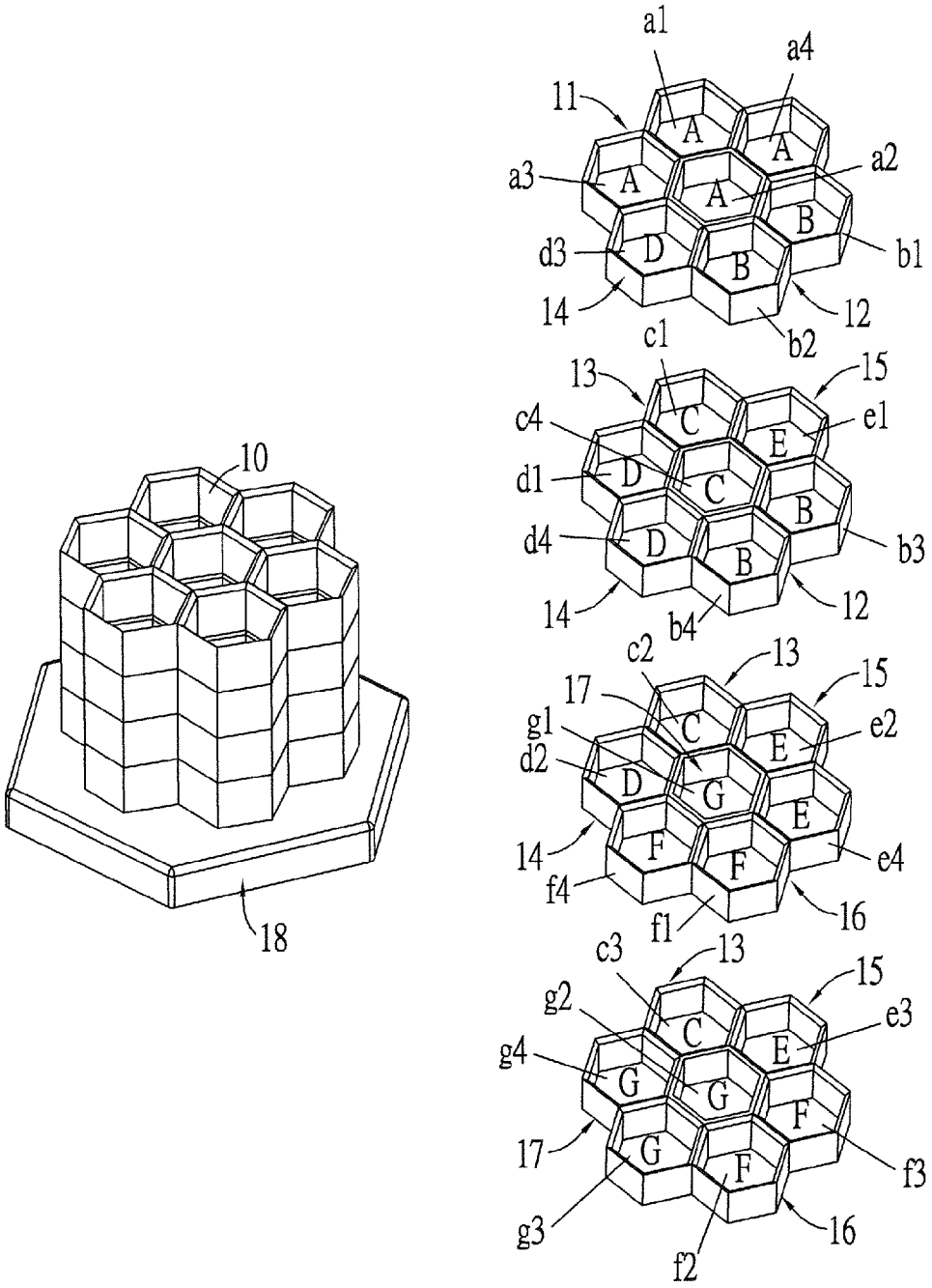
FIG. 3 is a schematic view illustrating each layer for an embodiment of a stacked assembly of the present invention.

Please refer FIGS. 1 to 3. A stand (18) is provided with a recess (181) can constitute a three-dimensional structure according to the recess (181) when accommodating the blocks A to G (11~17) in a variety of assembly. As shown in figures, the shape of the recess (181) of the stand (18) is constituted by a central hexagon with its six edges connecting six other hexagons. The recess (181) has location A(182), location B(183), location C(184), location D(185), location E(186) location F(187) and location G(188). As shown in the figures, the stacked height is four layers and each layer has seven elements (10) resulting in twenty eight elements (10) in total. The way of stacking is that block G(17) is placed with its second element (g2), third element (g3) and fourth element (g4) underneath into the corresponding location C(184), location D(185) and location G(188) respectively and then the block F(16) is placed with its second element (f2) and third element (f3) into the corresponding location B(183) and location A(182) respectively with its fourth element (f4) above the third element (g3). Then the block E(15) is placed with its third element (e3) into the corresponding location F(187) and the block C(13) is next placed with its third element (c3) into the corresponding location E(186) and its fourth element (c4) above the first element (g1) while the block D(14) is next placed with its second element (0) and fourth element (d4) underneath above two fourth elements (g4) and (f4) respectively. Then the block B(12) is placed with its third element (b3) and fourth element (b4) above the fourth element (e4) and the third element (0) respectively while the block A(11) is placed with its first, second, third and fourth elements (a1), (a2), (a3) and (a4) above the first element (c1), the fourth element (c4), the first element (d1) and the first element (e1) respectively. Thus the block assembly is completely stacked in position as shown in FIG. 3, illustrating the sequence of stacking the block A to G (11~17).

Figure 4:
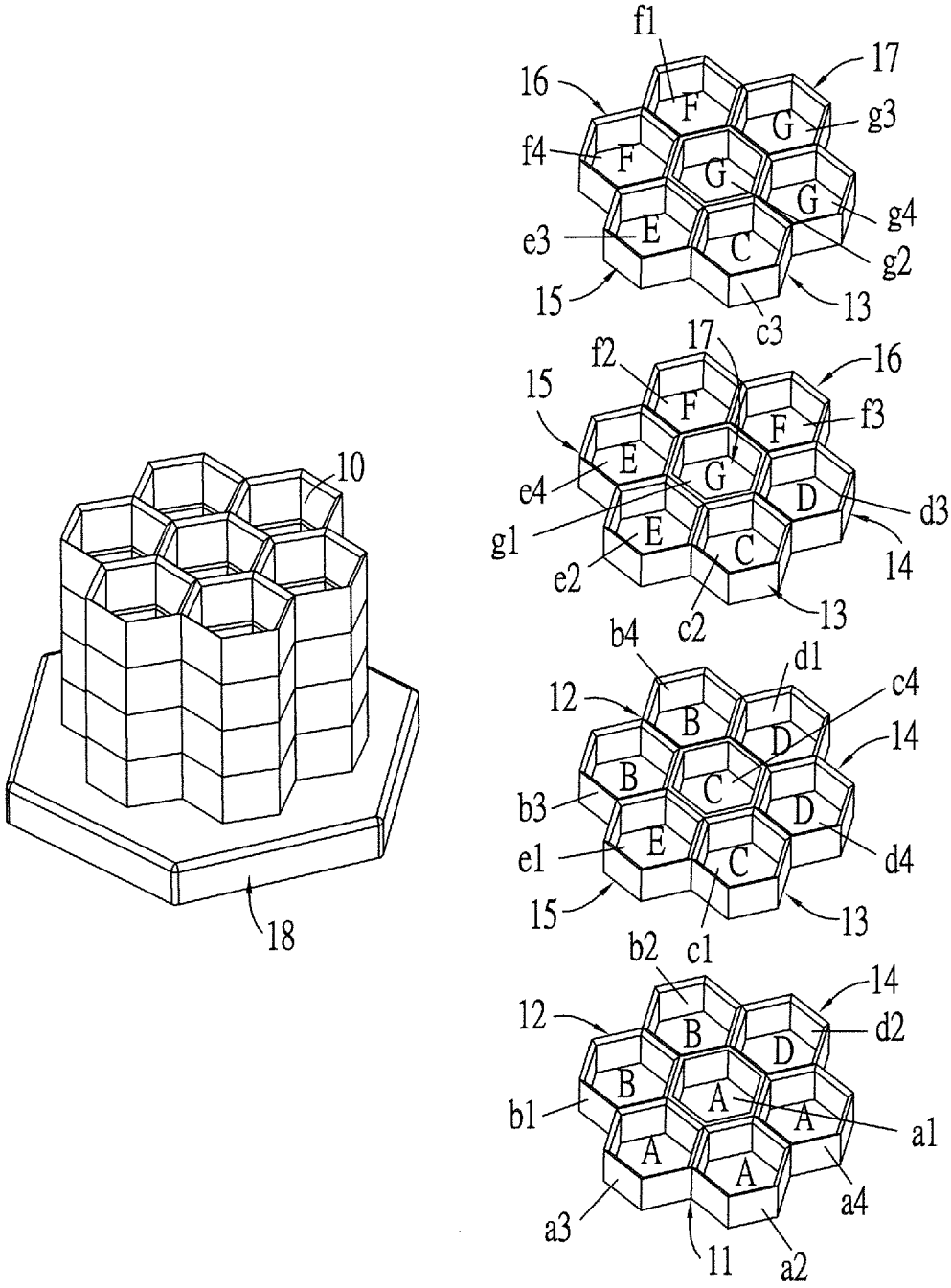
FIG. 4 is a schematic view illustrating each layer for another embodiment of the present invention.
Figure 5:
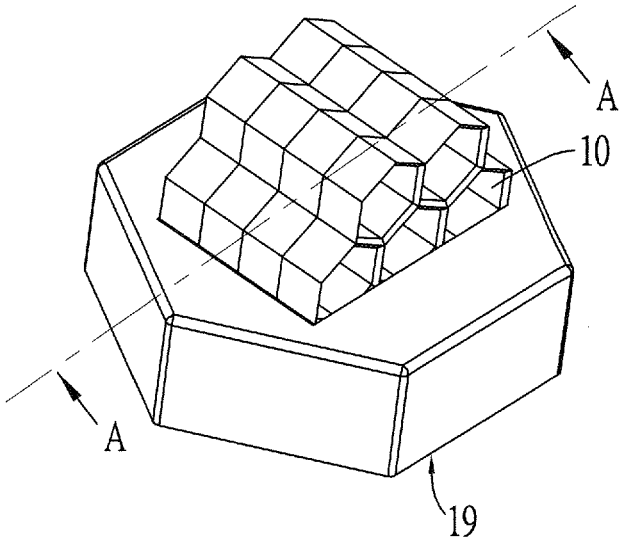
FIG. 5 is a perspective view illustrating the other embodiment of the present invention.
Figure 6:
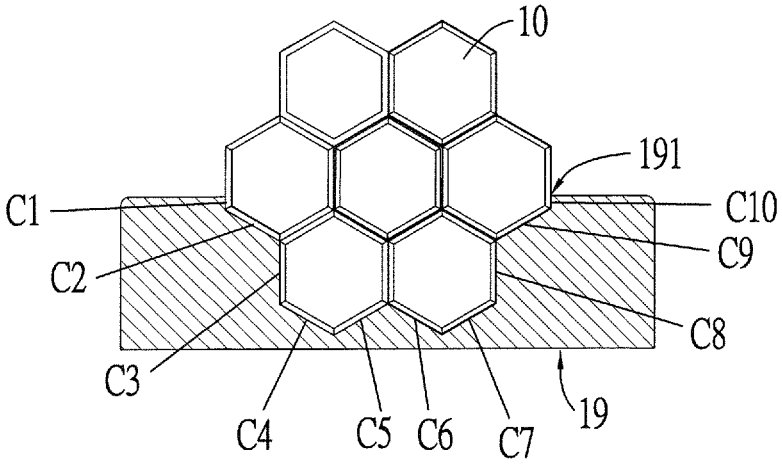
FIG. 6 is a cross-section schematic view of the other embodiment of the present invention.

Please refer FIG. 4 illustrating another embodiment of the present invention. First the block A(11) is placed with its first, second, third and fourth elements (a1) to (a4) into the corresponding location G(188), location B(182), location C(184) and location A(182). Afterwards the block B(12) is placed with its first element (b1) and second element (b2) into the corresponding location D(185) and location E(186), the block D(14) is placed with its second element (d2) into the location F(187) with its fourth element (d4) above the third element (a3). Then the block C(13) is placed with its first element (c1) and fourth element (c4) above the second element (a2) and first element (a1) respectively, the block E(15) is next placed with its first element (e1) and fourth element (e4) above two third elements (a3) and (b3) respectively, the block F(16) is next placed with its fourth element (f4), second element (12) and third element (13) above the fourth element (e4), the fourth element (b4) and the first element (d1) respectively, and the block G(17) is next placed with its first element (g1), third element (g3) and fourth element (g4) above the fourth element (c4), third element (f3) and third element (d3) respectively. Seven blocks A to G (11~17) are thus completely stacked into an assembly.

Figure 7:
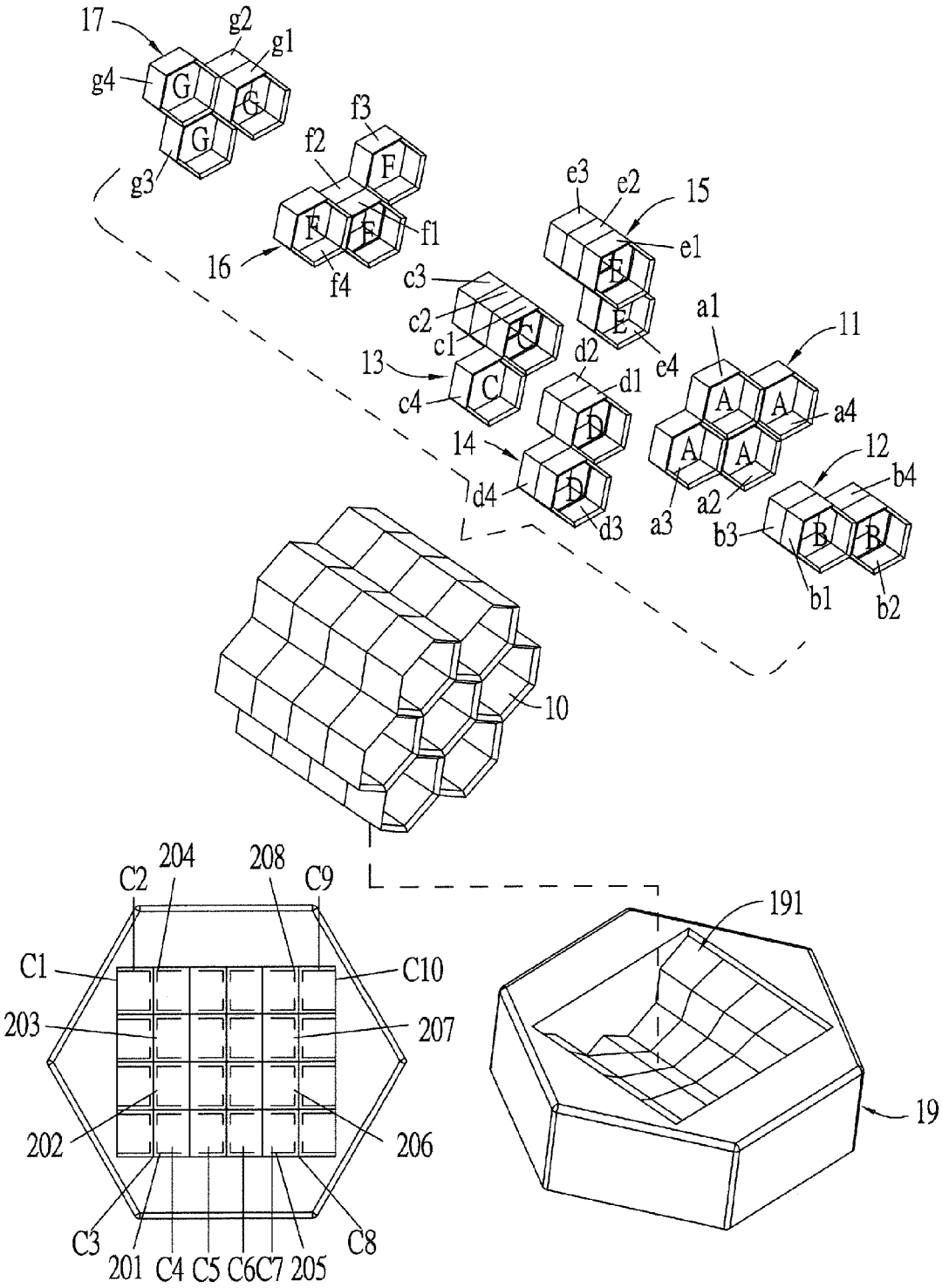
FIG. 7 is a schematic three-dimension view illustrating the assembly of the other embodiment of the present invention.
Figure 8:
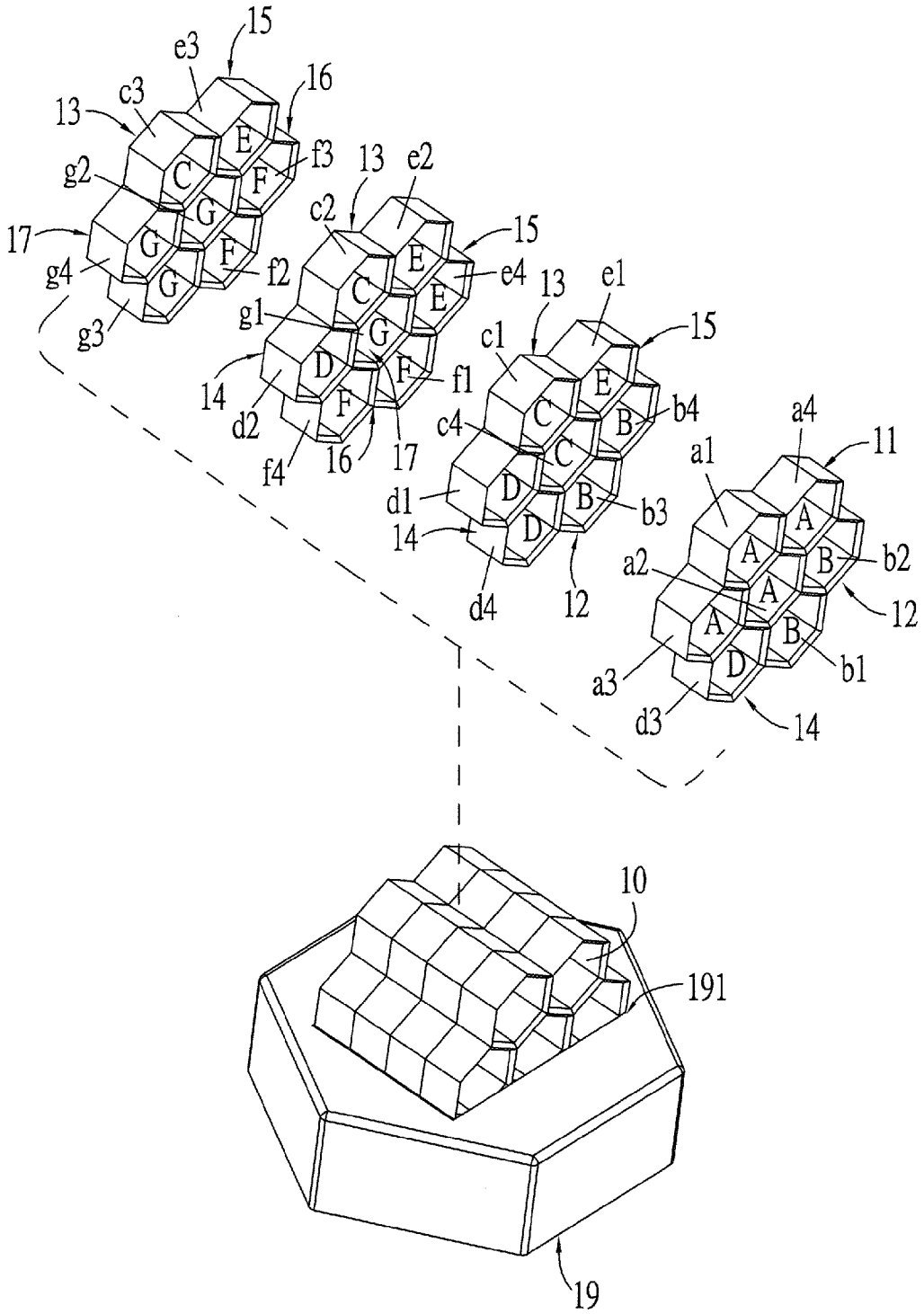
FIG. 8 is a schematic view illustrating each layer of the stacked assembly of the other embodiment of the present invention.

Please refer FIG. 5 through 8 illustrating the other embodiment using a stand (19) of different design. The stand (19) can accommodate the same blocks A to G (11~17) in a horizontal direction so as to enhance the educational value for the present invention with a variety of assembly and sequence. The stand (19) is provided with an inside recess (191) having multiply planes 1 to 10 (C1~C10) that plane 1 (C1) to plane 2 (C2), plane 3 (C3) to plane 4 (C4), plane 4 (C4) to plane 5 (C5), plane 6 (C6) to plane 7 (C7) and plane 9 (C9) to plane 10 (C10) are at an angle of 120 degrees while plane 2 (C2) to plane 3 (C3), plane 5 (C5) to plane 6 (C6) and plane 8 (C8) to plane 9 (C9) are at an angle of 240 degrees. Thereby both angles of 120 and 240 degrees constituted by the multiply planes 1 to 10 (C1~C10) can accommodate the blocks A to G (11~17) in a height of three layers with respective quantity of eight, twelve and eight units of element (10) from bottom to top resulting in total twenty eight elements (10) as well as to provide easy maneuver by fingers. The blocks A to G (11~17) of the present invention are in hexagonal form with an angle of 120 degrees between two adjacent edges such that the aforesaid planes at an angle of 120 degrees matches a hexagonal element (10) when it is placed into position so as to stabilize each of the blocks A to G (11~17). For example, plane 4 (C4) to plane 5 (C5) at an angle of 120 degrees is in accordance with the hexagonal element (10). From the above-mentioned the stand (19) accommodates the height of three layers that the bottom layer has eight hexagonal elements (10) in an assembly sequence as shown in FIG. 7 and FIG. 8 of location A'(201), location B'(202), location C'(203), location D'(204), location E'(205), location F'(206) location G'(207) and location H'(208). When placing the blocks A to G (11~17), first the block G(17) is placed with its third element (g3) into the corresponding location D'(204) and the block F(16) is placed with its second element (f2), first element (f1) and fourth element (f4) into the corresponding location H'(208), location G'(207) and location C'(203) respectively. Then the block D(14) is placed with its fourth element (d4) and third element (d3) into the corresponding location B'(202) and location A'(201) respectively and the block B(12) is placed with its third element (b3) and first element (b1) into the corresponding location F'(206) and location E'(205) respectively. The bottom layer is thereby completely stacked. Afterwards the block C(13) is placed with its third element (c3), second element (c2) and fourth element (c4) above the second element (g2), first element (g1) and third element (b3) respectively and the block E(15) is next placed with its third element (e3) and first element (e1) above the third element (f3) and fourth element (b4) respectively while its second element (e2) and fourth element (e4) at the right-hand-side of the second element (c2) and first element (g1) respectively. Finally the block A(11) is placed with its third element (a3), second element (a2) and fourth element (a4) above the third element (d3), the first element (b1) and second element (b2) respectively so as to completely stack seven blocks A to G (11~17) into the stand (19).

Figure 9:
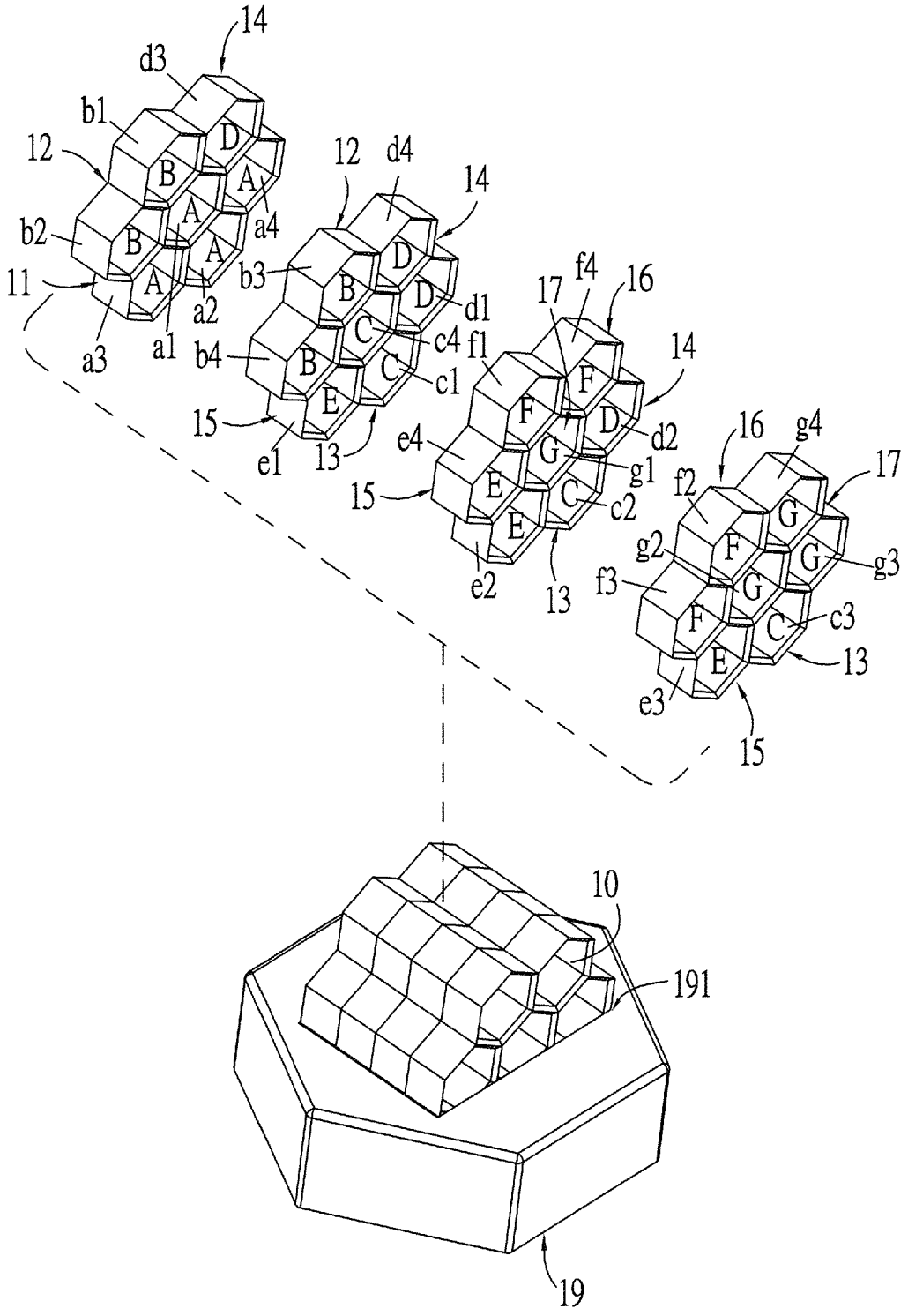
FIG. 9 is a schematic view illustrating each layer of an alternative assembly of the other embodiment of the present invention.

Please refer FIG. 9 illustrating an alternative assembly of blocks A to G (11~17) of the other embodiment. The block A(11) is placed with its third element (a3) and second element (a2) into the corresponding location D'(204) and location H'(208) respectively and then the block E(15) is placed with its first element (e1), second element (e2) and third element (e3) into the corresponding location C'(203), location B'(202) and location A'(201) respectively. The block C(13) is next placed with its first element (c1), second element (c2) and third element (c3) into the corresponding location G"(207), location F"(206) and location. E"(205) respectively so as to completely stack the bottom layer. Then the block B(12) is placed with its second element (b2), fourth element (b4), first element (b1) and third element (b3) above the third element (a3), first element (c1), first element (a1) and fourth element (c4) respectively while the block D(14) is next placed with its third element (d3) at the right-hand-side of the first element (hi) and its fourth element (d4) and first element (d1) at the right-hand-side of the third element (b3) and fourth element (c4). The block F(16) is next placed with its fourth element (f4) and third element (f3) above the second element (d2) and third element (e3) respectively and finally the block G(17) is placed with its first element (g1) and second element (g2) above the second element (c2) and third element (c3) respectively while its fourth element (g4) at the right-hand-side of the second element (12) so as to completely stack seven blocks A to G (11~17) into the stand (19). In summary, the hexagonal block and its stand of the present invention has various ways of assembly that can further use different stands in order to stack in either vertical or horizontal directions so as to derivate different combination of assembly. Moreover, the hexagonal block and its stand can extend the types, forms and quantity of blocks in accordance with the quantity accommodated by the stand for achieving a diversity of block assembly that can effectively stimulate the players in thinking and learning through the block maneuver within the three-dimensional space.

I claim:

1. A hexagonal block system, consisting of:

a stand; and exactly seven three-dimensional blocks which includes a first block, a second block, a third block, a fourth block, a fifth block, a sixth block and a seventh block; each of said blocks being respectively composed of exactly four elements which includes a first element, a second element, a third element and a fourth element; each of said elements being hexagonal in shape and having a top, a bottom opposite to the top, and six sides connecting the top and the bottom; each of said elements being exactly the same shape and size with each other; each of said elements being fixed to at least one neighboring element of the same block in such a manner that, the four elements of the same block cannot be detached; configurations of the seven blocks being different from each other; wherein:

the first block has a first configuration that, the four elements of the first block are all located on a horizontal plane in such a manner that, a first side of the first element is fixedly attached to a first side of the second element horizontally, two neighboring sides of the third element are fixedly attached to a second side of the first element and a second side of the second element horizontally respectively, two neighboring sides of the fourth element are fixedly attached to a third side of the first element and a third side of the second element horizontally respectively;

the second block has a second configuration that, the four elements of the second block are all located on a vertical plane in such a manner that, a first side of the first element is fixedly attached to a first side of the second element horizontally, a top of the third element is fixedly attached to a bottom of the first element vertically, a top of the fourth element is fixedly attached to a bottom of the second element vertically while having a first side of the fourth element being fixedly attached to a first side of the third element horizontally;

the third block has a third configuration that, the four elements of the third block are all located on the vertical plane in such a manner that, a bottom of the first element is fixedly attached to a top of the second element vertically, a bottom of the second element is fixedly attached to a top of the third element vertically, a first side of the fourth element is fixedly attached to a first side of the first element horizontally;

the fourth block has a fourth configuration that, the four elements of the fourth block are all located on the vertical plane in such a manner that, a bottom of the first element is fixedly attached to a top of the second element vertically, a bottom of the third element is fixedly attached to a top of the fourth element vertically, a first side of the fourth element is fixedly attached to a first side of the first element horizontally, there is no direct contact between the second element and the third element;

the fifth block has a fifth configuration that, the four elements of the fifth block are all located on the vertical plane in such a manner that, a bottom of the first element is fixedly attached to a top of the second element vertically, a bottom of the second element is fixedly attached to a top of the third element vertically, a first side of the fourth element is fixedly attached to a first side of the second element horizontally;

the sixth block has a sixth configuration that, the four elements of the sixth block are not located on the same plane in such a manner that, a bottom of the first element is fixedly attached to a top of the second element vertically, a first side of the third element is fixedly attached to a first side of the second element horizontally, a first side of the fourth element is fixedly attached to a first side of the first element horizontally, the fourth element is not located on a vertical plane defined by the first, second and third elements, there is no direct contact between the third element and the fourth element;

the seventh block has a seventh configuration that, the four elements of the seventh block are not located on the same plane in such a manner that, a bottom of the first element is fixedly attached to a top of the second element vertically, a first side of the third element is fixedly attached to a first side of the second element horizontally, two neighboring sides of the fourth element are fixedly attached to a second side of the second element and a second side of the third element horizontally respectively;

the first to seven blocks are combinable with each other to form a detachable combination comprising four layers that are vertically stacked, each of the four layers comprises exactly seven elements located on the horizontal plane so that the combination comprises exactly twenty-eight elements in total; and the stand has a recess which is sized and shaped for accommodating a portion of the combination of the first to seventh blocks.

2. The hexagonal block system according to claim 1, wherein the recess of the stand is sized and shaped for accommodating at least a lowermost one of the four layers of the combination in such way that the seven elements of the lowermost layer are fit in the recess.

3. The hexagonal block system according to claim 1, wherein the recess of the stand is sized and shaped for accommodating the portion of the combination of the first to seventh blocks in a transverse orientation in such a manner that, the twenty eight elements of the first to seventh blocks are divided, in a height direction, into three layers respectively comprising eight, twelve and eight elements.

4. The hexagonal block system according to claim 3, wherein a cross-sectional view of the recess of the stand comprises ten walls which includes: a first wall which is vertical, a second wall extending from the first wall and defining an included angle of 120 degrees with respect to the first wall, a third wall extending from the second wall and defining an included angle of 240 degrees with respect to the second wall, a fourth wall extending from the third wall and defining an included angle of 120 degrees with respect to the third wall, a fifth wall extending from the fourth wall and defining an included angle of 120 degrees with respect to the fourth wall, a sixth wall extending from the fifth wall and defining an included angle of 240 degrees with respect to the fifth wall, a seventh wall extending from the sixth wall and defining an included angle of 120 degrees with respect to the sixth wall, an eighth wall extending from the seventh wall and defining an included angle of 120 degrees with respect to the seventh wall, a ninth wall extending from the eighth wall and defining an included angle of 240 degrees with respect to the eighth wall, and a tenth wall extending from the ninth wall and defining an included angle of 120 degrees with respect to the ninth wall; wherein the tenth wall is vertical.

* * * * *